US011035557B2

(12) United States Patent
Xiang et al.

(10) Patent No.: US 11,035,557 B2
(45) Date of Patent: Jun. 15, 2021

(54) ADJUSTABLE HANGING ELEMENT FOR SUSPENDED LIGHT FIXTURES

(71) Applicant: MAXLITE, INC., West Caldwell, NJ (US)

(72) Inventors: Jun Xiang, Parsippany, NJ (US); Bryan Ortega, Kearny, NJ (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 16/864,217

(22) Filed: May 1, 2020

(65) Prior Publication Data

US 2020/0256548 A1 Aug. 13, 2020

Related U.S. Application Data

(63) Continuation of application No. 15/481,880, filed on Apr. 7, 2017, now Pat. No. 10,670,243.

(60) Provisional application No. 62/319,394, filed on Apr. 7, 2016.

(51) Int. Cl.

| | |
|---|---|
| ***F21V 21/02*** | (2006.01) |
| ***F21V 21/14*** | (2006.01) |
| ***F21V 17/02*** | (2006.01) |
| ***F21V 21/08*** | (2006.01) |
| *F21S 8/00* | (2006.01) |
| *F21V 21/10* | (2006.01) |
| *F21V 21/112* | (2006.01) |

(52) U.S. Cl.

CPC ..... *F21V 21/14* (2013.01); *F21V 17/02* (2013.01); *F21V 21/02* (2013.01); *F21V 21/08* (2013.01); *F21S 8/00* (2013.01); *F21V 21/10* (2013.01); *F21V 21/112* (2013.01)

(58) Field of Classification Search

CPC ..... F21V 21/14; F21V 21/28; F21V 21/008; F21V 21/00; F21V 21/02; F21V 21/03; F21V 21/04; F21V 21/041; F21V 21/06; F21V 21/10; F21V 21/112; F21V 17/005; F21V 17/02; F21V 17/04; F21V 17/06; F21V 17/08; F21V 17/12; F21S 8/00; F21S 8/03

See application file for complete search history.

(56) References Cited

U.S. PATENT DOCUMENTS

| | | | | | |
|---|---|---|---|---|---|
| 2,861,121 | A * | 11/1958 | Wolar | F21V 21/16 | 174/61 |
| 3,911,588 | A * | 10/1975 | Ohneda | G01C 15/105 | 33/286 |
| 4,368,506 | A * | 1/1983 | Rapp | F21V 21/03 | 362/147 |
| 4,443,168 | A * | 4/1984 | Dworak | B23P 11/00 | 29/464 |
| 4,999,748 | A * | 3/1991 | Aoshika | F21V 21/02 | 362/147 |

(Continued)

FOREIGN PATENT DOCUMENTS

| | | |
|---|---|---|
| CN | 205037203 U | 2/2016 |
| FR | 2587089 A1 | 3/1987 |

*Primary Examiner* — Rajarshi Chakraborty
*Assistant Examiner* — Fatima N Farokhrooz
(74) *Attorney, Agent, or Firm* — Budzyn IP Law, LLC

(57) ABSTRACT

An adjustable hanging element is provided herein for suspended light fixtures which allows for adjustment of a point of contact for suspension both upon initial installation and while installed, without the need for taking the fixture down.

10 Claims, 5 Drawing Sheets

(56) References Cited

U.S. PATENT DOCUMENTS

| | | | | |
|---|---|---|---|---|
| 5,349,513 | A * | 9/1994 | Taylor, III | F21S 8/04 362/147 |
| 5,609,413 | A | 3/1997 | Lecluze | |
| 6,394,869 | B1 * | 5/2002 | Haugaard | F21V 15/01 362/147 |
| 6,676,442 | B2 | 1/2004 | Kerr, Jr. | |
| 8,985,535 | B1 | 3/2015 | Townsend, Jr. | |
| 2009/0231837 | A1 | 9/2009 | Kassay et al. | |
| 2011/0177708 | A1 * | 7/2011 | Smith | B60R 25/00 439/332 |
| 2013/0016504 | A1 | 1/2013 | Garber | |
| 2013/0264434 | A1 * | 10/2013 | Unno | F16M 11/105 248/58 |
| 2015/0198760 | A1 * | 7/2015 | Wilcox | F21K 9/61 362/606 |
| 2015/0354766 | A1 * | 12/2015 | Townsend, Jr. | E01F 9/658 362/370 |
| 2017/0254519 | A1 * | 9/2017 | Tanimura | F21V 23/002 |
| 2018/0073695 | A1 * | 3/2018 | Kaneko | F21V 33/0052 |

* cited by examiner

ADJUSTABLE HANGING ELEMENT FOR SUSPENDED LIGHT FIXTURES

CROSS-REFERENCE TO RELATED APPLICATIONS

This application is a continuation of U.S. patent application Ser. No. 15/481,880, filed Apr. 7, 2017, now allowed, which claims priority to U.S. Provisional Patent Application No. 62/319,394, filed Apr. 7, 2016, the contents of which are incorporated by reference herein.

BACKGROUND OF THE INVENTION

Suspended light fixtures are known in the prior art, such as high-bay light fixtures. Often, suspended light fixtures utilize one or more points of contact for hanging, such as being hung by hook-shaped or loop-shaped member(s) engaging a suspension cable.

As appreciated by those skilled in the art, weight distribution in a suspended light fixture will affect the angle of the fixture's downward throw of light. Typically, the plumbness of a light fixture is checked upon installation. However, the subsequent addition of components, such as back-up battery packs, step down transformers, etc., and time lapse of installation may cause eccentric loading resulting in angled, non-true light throw.

SUMMARY OF THE INVENTION

An adjustable hanging element is provided herein for suspended light fixtures which allows for adjustment of a point of contact for suspension both upon initial installation and while installed, without the need for taking the fixture down.

These and other features of the subject invention will be better understood through a study of the following detailed description and accompanying drawings.

DETAILED DESCRIPTION OF THE INVENTION

Figure 1:
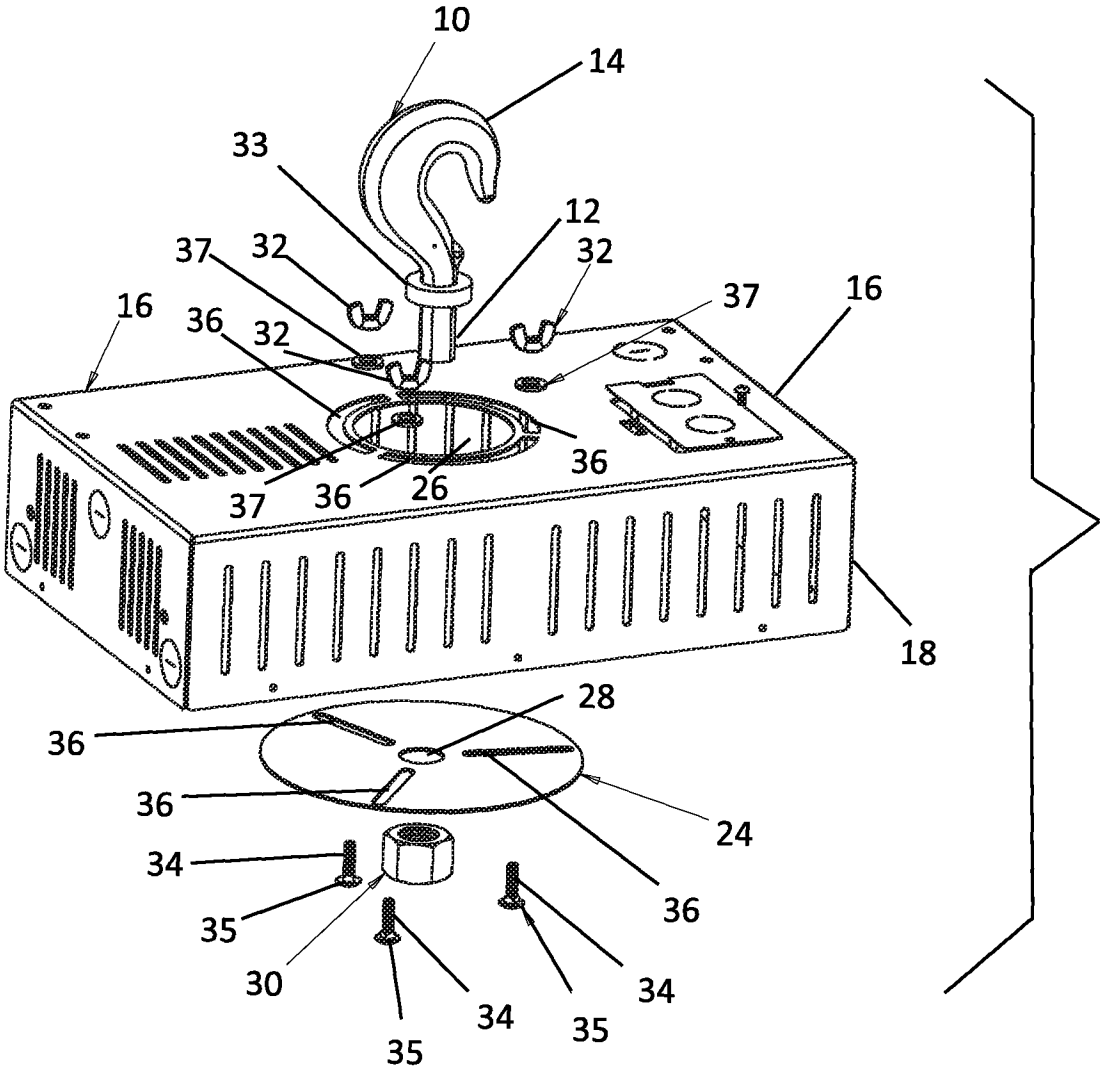
FIGS. 1-6B show various aspects of the subject invention.
Figure 1B:
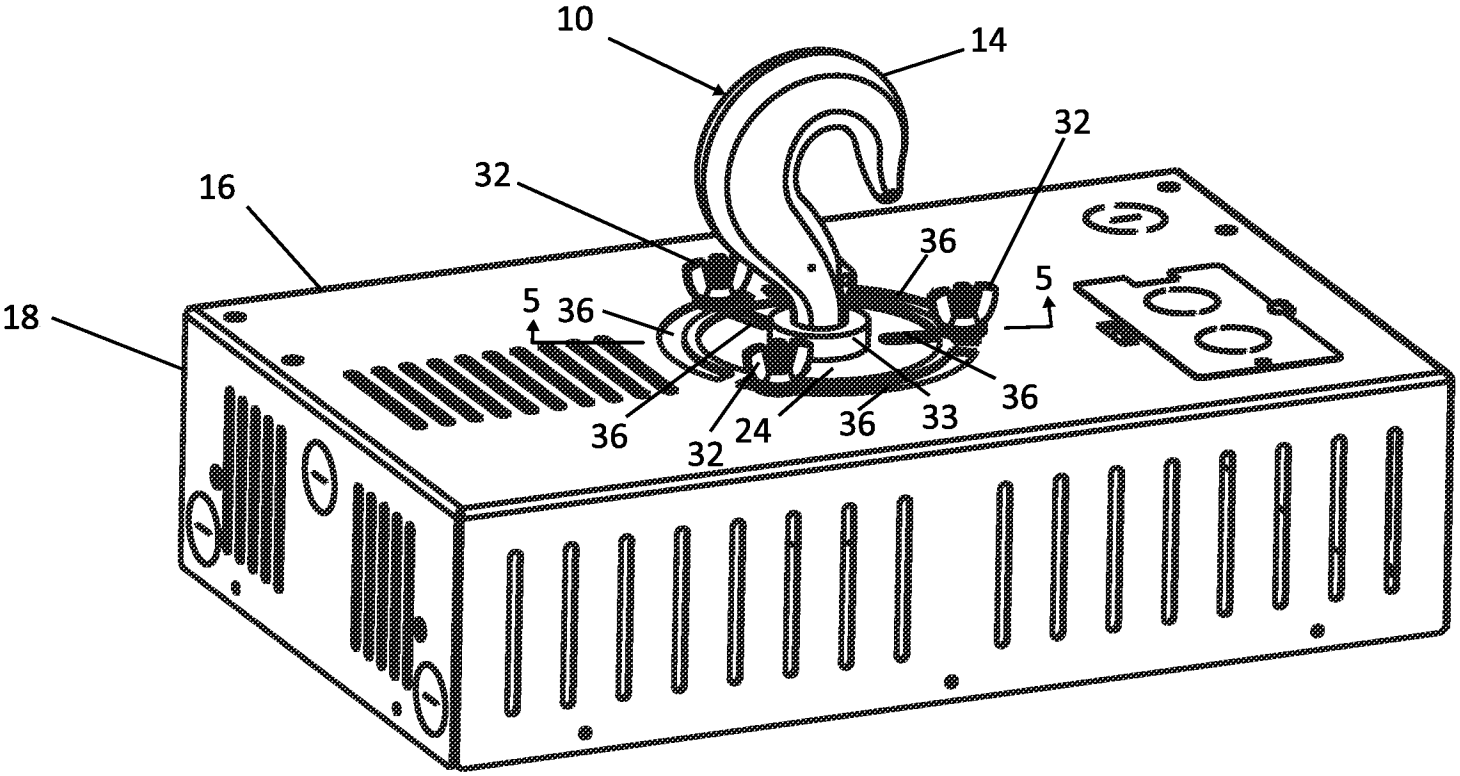
Figure 2:
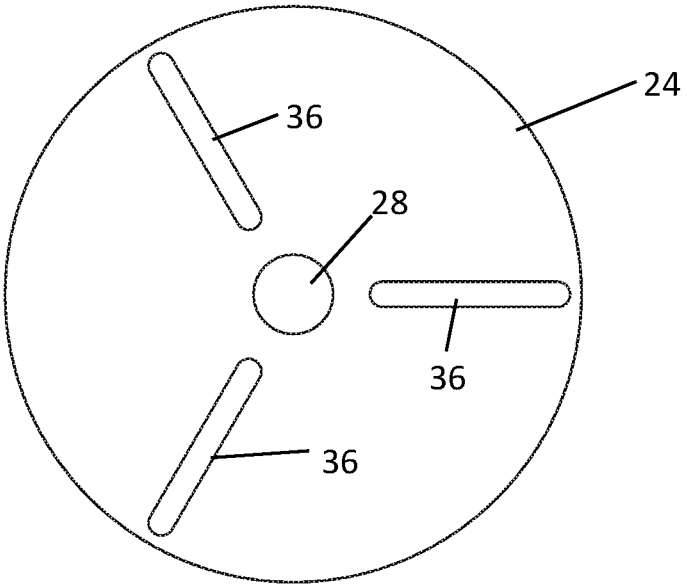

With reference to the Figures, a hanging element 10 is provided having a shank 12 and a bent portion 14. The bent portion 14 may be hook- or loop-shaped. The hanging element 10 is useable with a suspendable light fixture 16 having a housing 18 and reflector 20. Any known suspendable light fixture may be used with the subject invention with all necessary electrical components being accommodated in or about the housing 18 with one or more light generating elements 22 being accommodated by the reflector 20. The light generating elements 22 may be of any form, including, but not limited to, incandescent, fluorescent, solid state (e.g., LED), etc.

Figure 3:
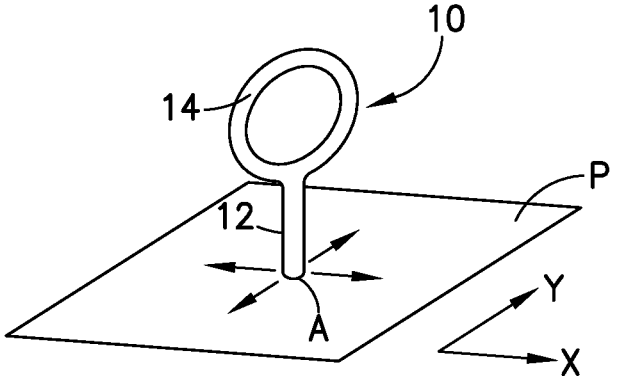
Figure 4:
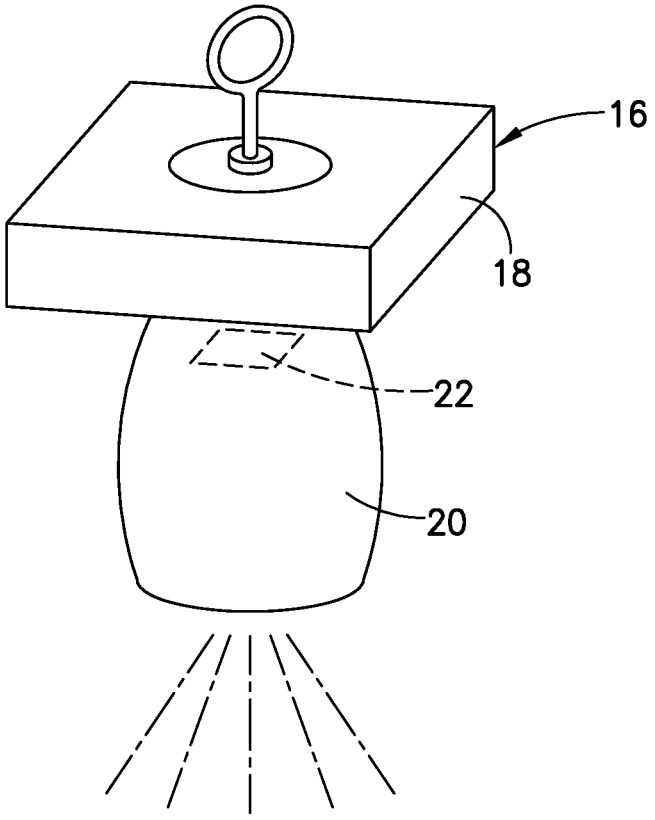
Figure 5:
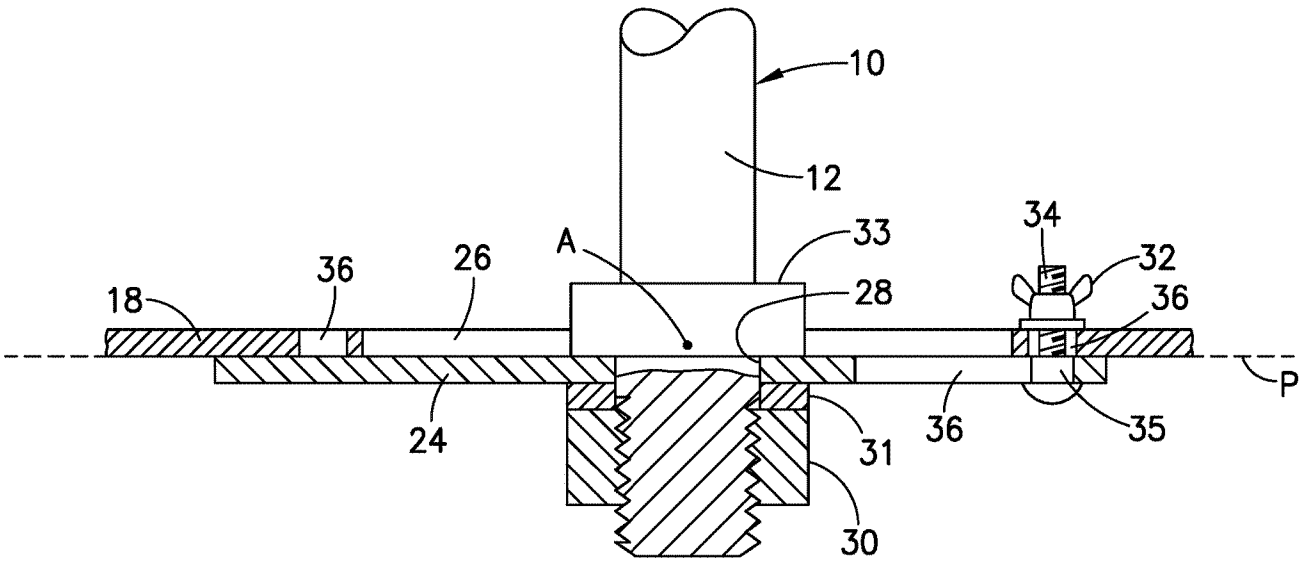

The shank 12 is provided to be multiaxially adjustable relative to the housing 18. By way of non-limiting example, the adjustability may be relative to a fixed point A on the shank 12 within a single plane P (FIG. 3); with this arrangement, the multiaxial adjustability is relative to two axes (e.g., x, y axes) within the plane P. With multiaxial adjustability within a single plane, the fixed point A on the shank 12 may be moved to various points within the plane.

Various modes may be utilized to secure the hanging element 10 to the housing 18. By way of non-limiting example, the shank 12 may be fixed to a plate 24 such that the plate 24 is moveable with the shank 12. Thus, the shank 12 may be adjusted relative to the housing 18 with movement of the plate 24 relative to the housing 18. An opening 26 may be formed in the housing 18, formed preferably smaller than the plate 24 such that the plate 24 may not pass through the opening 26. Preferably, the opening 26 is formed in an upward-facing surface of the housing 18 (upward being in a direction contrary to gravity). The plate 24 may be located interiorly of, and adjacent to, the opening 26, within the housing 18. With the plate 24 being larger in size than the opening 26, the light fixture 16 may be supported in suspension by the hanging element 10 with weight transfer through the plate 24. Preferably, the plate 24 is formed sufficiently robust (with one or more considerations of: thickness, material selection, shape, sufficient overlapping contact with the housing 18) to support at least the full weight of the light fixture 16.

The shank 12 may be fixed to the plate 24 in any known manner. For example, the plate 24 may have an aperture 28 through which the shank 12 passes with the shank 12 being fixed relative to the aperture 28. Preferably, the shank 12 is at least partially threaded with at least one nut 30 being used to fix the shank 12 to the plate 24. Optionally, one or more washers 31 may be utilized between the nut 30 and the plate 24. Also, optionally, a collar 33 may be provided on the shank 12 larger in diameter than the aperture 28 to resist passage therethrough. The plate 24 may be in pressing engagement with the collar 33, with the shank 12 fixed to the plate 24. In addition, or alternatively, the shank 12 may be fixed to the plate 24 by mechanical interactions (e.g., interference fit, mating edge and slot), adhesion and/or fusion. The plate 24 may be unitarily formed with the shank 12.

With the plate 24 being located adjacent the opening 26, the plane P of adjustability is located adjacent to the opening 26. The fixed point A on the shank 12 is locatable on all points bounded by the opening 26. The opening 26 sets a boundary for the range of adjustability of the shank 12.

Figure 6B:
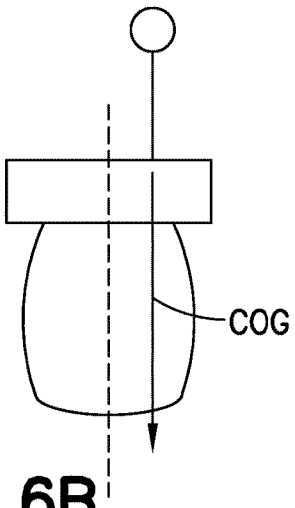
Figure 6A:
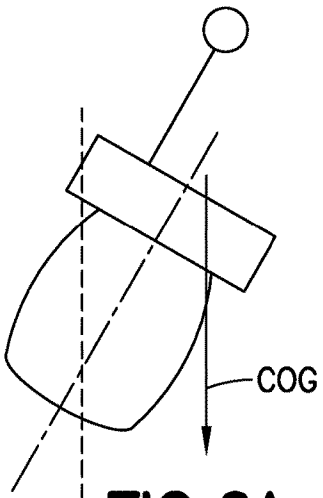

By allowing for adjustment of the shank 12, the location of the bent portion 14 of the hanging element 10 is adjusted relative to the housing 18. With the bent portion 14 defining the point of suspension, adjustment of the bent portion 14 allows for adjustment of the point of suspension relative to the housing 18. In this manner, the overall weight distribution of the housing 18 is kept constant, with the bent portion 14 being moved to compensate for eccentric loading. For single point suspended light fixtures, the bent portion 14 may be located to be substantially in alignment with a center of gravity of the light fixture 16 as considered along a vertical (gravitational) axis to minimize non-true light throw. As understood by those skilled in the art, the center of gravity of the light fixture 16 may be altered by the addition of components, such as back-up battery packs, step down transformers, etc., and/or the shifting or settling of portions of the light fixture 16 resulting from time lapse at an installation or external factors. As shown in FIG. 6A, the center of gravity COG of the light fixture 16 may cause the light fixture 16 to be askew to a vertical (true) axis. The location of the center of gravity COG may result in eccentric loading and non-true light throw. The adjustment of the hanging element 10 may re-align the point of suspension with the center of gravity COG, as shown in FIG. 6B, thus, providing the light fixture with improved downward alignment.

The light fixture 16 may be suspended by more than one point contact. As will be appreciated by those skilled in the art, more than one of the hanging elements 10 may be utilized, preferably one at each point of suspension (although it may be possible to use the hanging element(s) 10 in combination with fixed points of suspension). With a plurality of the hanging elements 10, iterative adjustment of the hanging elements 10 may be needed to achieve best downward throw. Adjustment of a single hanging element 10 may not be sufficient to achieve best results. The loci of all suspension points, including the hanging elements 10 and any fixed suspension points, collectively will act relative to the center of gravity of the light fixture.

The shank 12 is preferably releasably lockable to the housing 18. Any manner of releasable locking may be utilized. By way of non-limiting example, releasable fasteners may be utilized. For example, one or more locking nuts 32 (e.g., in the form of wing nuts) may be provided which threadedly engage threaded stems 34 located on the housing 18 and/or the plate 24. Optionally, washers 37 may be utilized. The threaded stems 34 may be provided as bolts or screw. Corresponding locking slots 36 may be provided on the housing 18 and/or the plate 24 through which the threaded stems 34 may pass. With the locking nuts 32 being tightened, the plate 32 may be releasably locked to the housing 18. With the locking nuts 32 being loosened, the plate 24 may be adjusted relative to the housing 18, and then tightened when in a desired location. A releasable locking arrangement allows for adjustment of the shank 12 with the light fixture 16 being suspended, thus avoiding the need to take down the light fixture 16.

Preferably, the threaded stems 34 are each provided in bolt form and include a collar 35 below a head with the collar 35 being shaped to be seated within one of the locking slots 36 so as to resist relative rotation thereto.

Preferably, three of the locking slots 36 are provided with the plate 24 at equidistant intervals radiating outwardly. In addition, preferably three of the locking slots 36 are provided with the housing 18, particularly in arcuate form spaced evenly about the perimeter of the opening 26. It is preferred that each threaded stem 30 passes through both one of the locking slots 36 in the plate 24 and through one of the locking slots 36 in the housing 18. With the locking nuts 32, the threaded stems 30 may be simultaneously releasably locked to the plate 24 (and, thus, the shank 12) and to the housing 18. With the combination of arcuate locking slots 36 in the housing 18 and outward radiating locking slots 36 in the plate 24, the plate 24 may be rotated and axially shifted to adjust the location of the shank 12. As will be understood by those skilled in the art, other quantities of the locking slots 36 in both the housing 18 and/or the plate 24 may be used.

What is claimed is:

1. A suspendable lighting fixture comprising:

a housing including an opening formed in an upward facing surface of said housing;

a reflector mounted to said housing, said reflector configured to accommodate at least one light generating element;

a plate located adjacent to said opening within said housing with said opening being sized smaller than said plate such that said plate cannot pass through said opening; and, a hanging element including a shank attached to said plate at a fixed point and a bent portion located externally of said housing for suspending the light fixture, wherein said fixed point is multiaxially adjustable relative to two axes within a single plane relative to said housing, wherein said shank extends through said opening with said fixed point located within said housing and with said bent portion located externally of said housing, and, wherein said fixed point is axially shiftable within said single plane to allow said fixed point to be adjusted out of alignment with a center of said opening and locatable on all points bounded by said opening with said opening setting a boundary for the range of adjustability of said shank.

2. A light fixture as in claim 1, wherein said single plane is adjacent to said opening.

3. A light fixture as in claim 1, wherein said single plane is parallel to said opening.

4. A light fixture as in claim 1, wherein said plate is releasably lockable to said housing.

5. A light fixture as in claim 1, wherein said bent portion may be hook- or loop-shaped.

6. A light fixture as in claim 4, wherein a plurality of locking slots is formed in said plate and in said housing with a plurality of releasable fasteners extending therethrough to releasably lock said plate to said housing.

7. A light fixture as in claim 6, wherein a plurality of said locking slots are provided in arcuate form spaced evenly about said opening, and a plurality of said locking slots are provided on said plate at equidistant intervals radiating outwardly.

8. A light fixture as in claim 6, wherein said releasable fasteners each include a collar being shaped to be seated within one of said locking slots so as to resist relative rotation thereto.

9. A light fixture as in claim 8, wherein said releasable fasteners each include a threaded stem.

10. A light fixture as in claim 9, wherein said releasable fasteners include locking nuts for threadedly engaging said threaded stems.

* * * * *